US010684578B2

(12) United States Patent
Konishi

(10) Patent No.: US 10,684,578 B2
(45) Date of Patent: Jun. 16, 2020

(54) IMAGE FORMING APPARATUS WITH AN ADJUSTABLE FIXING UNIT

(71) Applicant: FUJI XEROX CO., LTD., Tokyo (JP)

(72) Inventor: Masataka Konishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/293,669

(22) Filed: Mar. 6, 2019

(65) Prior Publication Data

US 2020/0096919 A1 Mar. 26, 2020

(30) Foreign Application Priority Data

Sep. 25, 2018 (JP) ..... 2018-178634

(51) Int. Cl.
*G03G 15/20* (2006.01)

(52) U.S. Cl.
CPC ..... *G03G 15/2028* (2013.01); *G03G 15/2039* (2013.01); *G03G 15/2064* (2013.01)

(58) Field of Classification Search
CPC ..... G03G 15/2028; G03G 15/2039; G03G 15/2064; G03G 2215/734; G03G 2215/772
USPC ..... 399/38, 45, 67–70, 107, 110, 122, 320, 399/328
See application file for complete search history.

(56) References Cited

U.S. PATENT DOCUMENTS 7,428,390 B2 * 9/2008 Ando ..... G03G 15/2039 399/328
8,509,639 B2 * 8/2013 Tao ..... G03G 15/2039 399/67
8,554,097 B2 * 10/2013 Hara ..... G03G 15/2039 399/122
8,953,960 B2 * 2/2015 Ueno ..... G03G 15/205 399/334

FOREIGN PATENT DOCUMENTS

JP 2012018268 1/2012
JP 2016109787 6/2016

* cited by examiner

*Primary Examiner* — Hoan H Tran
(74) *Attorney, Agent, or Firm* — JCIPRNET

(57) ABSTRACT

An image forming apparatus includes: an image forming unit that forms an unfixed image on a sheet; and a fixing unit that includes a first rotary member and a second rotary member, which are in contact with each other to form a nip part, and that fixes the unfixed image formed in the image forming unit to the sheet by allowing the sheet to pass through the nip part. When a large-width sheet having a larger width than a preceding sheet that has previously passed through the nip part is allowed to pass through the nip part, adjustment in which the first rotary member and the second rotary member are displaced in directions away from each other, while forming the nip part, is performed in the fixing unit.

15 Claims, 7 Drawing Sheets

IMAGE FORMING APPARATUS WITH AN ADJUSTABLE FIXING UNIT

CROSS-REFERENCE TO RELATED APPLICATIONS

This application is based on and claims priority under 35 USC 119 from Japanese Patent Application No. 2018-178634 filed Sep. 25, 2018.

BACKGROUND

(i) Technical Field

The present disclosure relates to image forming apparatuses.

(ii) Related Art

Japanese Unexamined Patent Application Publication No. 2012-18268 (claim 1, FIGS. 1, 6, etc.) and Japanese Unexamined Patent Application Publication No. 2016-109787 (claim 1, FIGS. 1, 6, etc.) disclose image forming apparatuses that address the problem of eliminating inconvenience caused by the presence of non-sheet-passing areas (i.e., areas in which a sheet does not pass) in fixing devices, which is caused by a difference in width of sheets.

Japanese Unexamined Patent Application Publication No. 2012-18268 discloses an image forming apparatus including: a fixing device; a cooling device that cools non-sheet-passing areas, in which recording media having a width smaller than or equal to a predetermined value do not pass, in the overall sheet-passing area of the fixing device in which the recording media pass; and a controller that controls the operation of the cooling device. After a print job involving recording media having a width smaller than or equal to a predetermined value is generated, the controller actuates the cooling device before the first recording medium enters the fixing device and causes the cooling device to continue the operation while the print job on those recording media is performed.

Japanese Unexamined Patent Application Publication No. 2016-109787 discloses an image forming apparatus including: an image forming unit; a fixing unit; a temperature measuring unit that measures the temperatures of a sheet-passing area and non-sheet-passing areas of a heating member or a pressure member of the fixing unit; and a controller that controls the production efficiency, which is represented by the number of pages or sheets output in a certain time. The controller includes: an image determination unit that determines an image to be fixed to a sheet; a temperature-difference calculation unit that calculates the difference in temperature between the sheet-passing area and the non-sheet-passing areas of the heating member or the pressure member on the basis of the temperatures measured by the temperature measuring unit; and a production-efficiency determination unit that determines the production efficiency on the basis of the result of the image determination performed by the image determination unit and the temperature difference calculated by the temperature-difference calculation unit.

SUMMARY

When a large-width sheet having a larger width than a preceding sheet that has previously passed through a nip part of a fixing unit is allowed to pass through the nip part, there may be a temperature difference between a sheet-passing portion, in which the preceding sheet has passed, and non-sheet-passing portions, in which the preceding sheet has not passed. Aspects of non-limiting embodiments of the present disclosure relate to an image forming apparatus in which it is possible to allow a large-width sheet to pass through a nip part while suppressing inconvenience caused by temperature difference.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image forming unit that forms an unfixed image on a sheet; and a fixing unit that includes a first rotary member and a second rotary member, which are in contact with each other to form a nip part, and that fixes the unfixed image formed in the image forming unit to the sheet by allowing the sheet to pass through the nip part. When a large-width sheet having a larger width than a preceding sheet that has previously passed through the nip part is allowed to pass through the nip part, adjustment in which the first rotary member and the second rotary member are displaced in directions away from each other, while forming the nip part, is performed in the fixing unit.

BRIEF DESCRIPTION OF THE DRAWINGS

Exemplary embodiment of the present disclosure will be described in detail based on the following figures, wherein.

DETAILED DESCRIPTION

Referring to the attached drawings, an exemplary embodiment of the present disclosure will be described below.

Exemplary Embodiment

Figure 1:
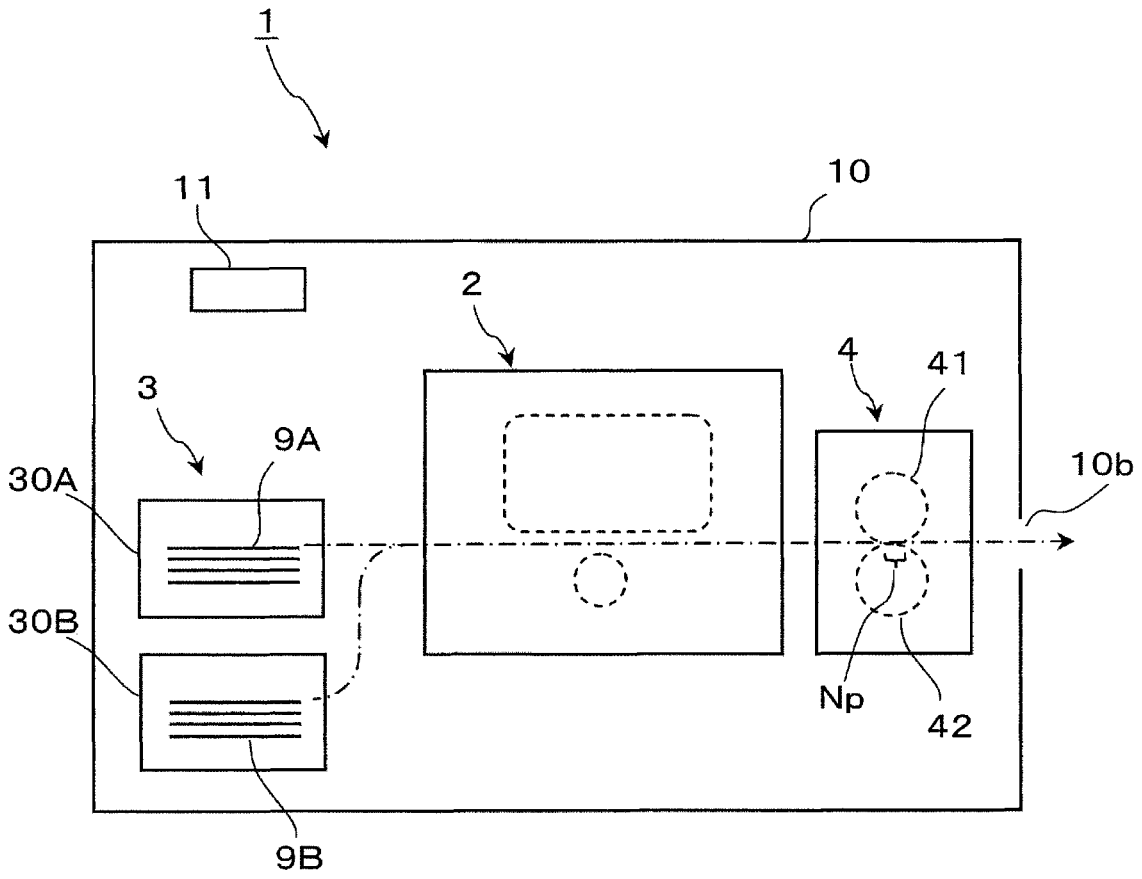
FIG. 1 shows the configuration of an image forming apparatus according to an exemplary embodiment.
Figure 2:
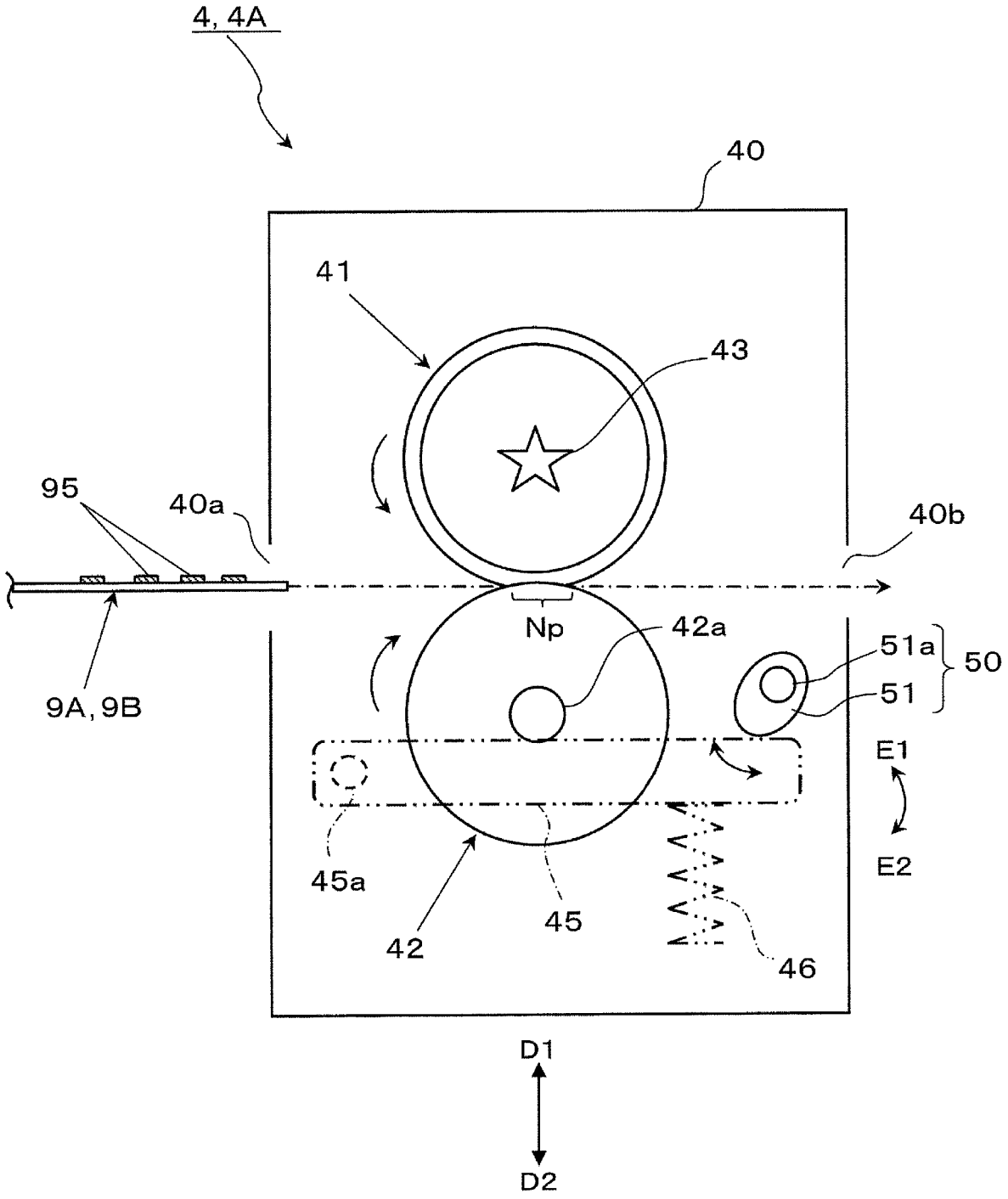
FIG. 2 shows the configuration of a fixing unit (fixing device)

FIG. 1 shows the configuration of an image forming apparatus according to an exemplary embodiment, and FIG. 2 shows a fixing unit (fixing device) of the image forming apparatus.

Configuration of Image Forming Apparatus

An image forming apparatus 1 includes, inside a housing 10: an image forming unit 2 that forms a toner image 95, serving as an example of an unfixed image formed of developer (toner), on a sheet 9; a paper feed unit 3 that accommodates sheets 9 and feeds a sheet 9 to the image forming unit 2; a fixing unit 4 that fixes the toner image 95 formed by the image forming unit 2 to the sheet 9; and a central controller 11 that controls the operations performed in the image forming apparatus 1. One-dot chain lines in FIG. 1 show transport paths of sheets 9 in the housing 10.

The image forming unit 2 forms a toner image 95 with developer (toner) by using an electrophotographic system or another image forming method and allows the toner image 95 to be transferred to a sheet 9. The image forming unit 2 forms, for example, a monochrome or a color toner image 95 corresponding to image information obtained from an external device, such as an information terminal, and the configuration (e.g., the type) thereof is not specifically limited. The image forming unit 2 also includes an image processing unit (not shown) that performs necessary processing on the image information.

The paper feed unit 3 includes sheet containers 30A and 30B that respectively accommodate a stack of sheets 9A and a stack of sheets 9B of a desired size and type, a feed device (not shown) that feeds the sheets 9A and 9B one-by-one from the sheet containers 30A and 30B to (a transfer part of) the image forming unit 2. The sheets 9A and 9B may be any recording media that can be transported in the housing 10 of the image forming apparatus 1 and to which toner images 95 can be transferred and fixed.

In this exemplary embodiment, for example, the sheets 9A are large-width (Lw) sheets, whose width during transportation is the maximum, and the sheets 9B are small-width (Ln) sheets, whose width during transportation is smaller than the maximum width.

In image formation, a toner image 95 corresponding to image information is formed in the image forming unit 2 by a known process in the electrophotographic system or another image forming method, and the thus-formed toner image 95 is transferred to at least one side of a sheet 9A or 9B supplied from the paper feed unit 3.

The fixing unit 4 includes a first rotary member 41 and a second rotary member 42, which is in contact with the first rotary member 41 to form a nip part Np for fixing.

In the fixing unit 4, a sheet 9 (9A or 9B) carrying a toner image 95 transferred thereto in the image forming unit 2 is allowed to pass through the nip part Np for fixing (for example, a sheet is heated under pressure), and thus, the toner image 95 is fixed to the sheet 9. The sheet 9 to which the toner image 95 has been properly fixed leaves the fixing unit 4, is output from a discharge port 10*b* provided in the housing 10, and is accommodated in an output-sheet accommodating unit (not shown) or the like provided on the outside of the housing 10.

Now, the detailed configuration of the fixing unit 4 will be described.

As shown in FIG. 2, the fixing unit 4 is configured as a fixing device 4A that includes the first rotary member 41 and the second rotary member 42 inside a housing 40.

The housing 40 has an introduction port 40*a* through which a sheet 9 carrying a toner image 95 enters the fixing unit 4 and a discharge port 40*b* through which the sheet 9 after fixing is discharged.

The first rotary member 41 serves as, for example, a heating rotary member that comes into contact with and heats the surface of the sheet 9 to which the toner image 95 has been transferred. The first rotary member 41 is configured as a heating roller that is supported at a fixed position so as to be able to rotate and includes: a hollow roller body; and a heat source 43 that is disposed inside the hollow roller body and heats the roller body from inside.

The roller body includes a roller-body base, which is made of metal or the like, and a thin elastic layer and a thin release layer formed on the outer circumferential surface of the roller-body base. The heat source 43 is, for example, a halogen heater.

The first rotary member 41 is driven so as to rotate in the direction indicated by an arrow by receiving power from a rotational-driving source 44 (see FIG. 3), which is composed of a motor, a driving-force transmitting mechanism, and the like.

The second rotary member 42 of the fixing device 4A is configured to as a pressure rotary member that comes into contact with and presses the surface of the sheet 9 to which the toner image 95 has not been transferred. The second rotary member 42 is configured as a pressure roller whose rotation shafts 42*a* at the ends are supported in a rotatable manner.

The rotation shafts 42*a* of the second rotary member 42 are supported, via bearings (not shown) or the like, by pivot arms 45, which pivot about a support shaft 45*a* in directions indicated by arrows E1 and E2 and which are urged by pressure springs 46 such that the second rotary member 42 is urged against the first rotary member 41 at a predetermined pressure. With this configuration, the pivot arms 45 pushed by the pressure springs 46 are maintained in a state continuing to pivot in the direction indicated by arrow E1, and thus, the second rotary member 42 is urged against the first rotary member 41 at a predetermined pressure to form the nip part Np.

The second rotary member 42, which is in contact with the rotating first rotary member 41, is driven by the first rotary member 41 and rotates in the direction indicated by the arrow.

As shown in FIG. 2, the fixing device 4A also includes displacement mechanisms 50 that displace the second rotary member 42 in direction D1 (i.e., the direction toward the first rotary member 41) and in direction D2 (i.e., the direction away from the first rotary member 41).

The displacement mechanisms 50 are each composed of an eccentric cam 51, which is provided at an end of a pivot arm 45 opposite to the end provided with the support shaft 45*a* and which is in contact with a side of the pivot arm 45 opposite to the side with which a pressure spring 46 is in contact. The eccentric cam 51 pivots (swings) about a driving shaft 51*a* in directions indicated by a double-pointed arrow within a predetermined angle. Furthermore, the driving shaft 51*a* is moved by a rotational-driving source 52 (see FIG. 3), which is composed of a stepping motor, a driving-force transmitting mechanism, and the like.

As shown in FIG. 2, the fixing device 4A includes, on the outside of the housing 40 and near the discharge port 40*b*, a sheet passing sensor 48 that detects completion of output of the trailing end of a sheet 9 that has gone through fixing.

Figure 3:
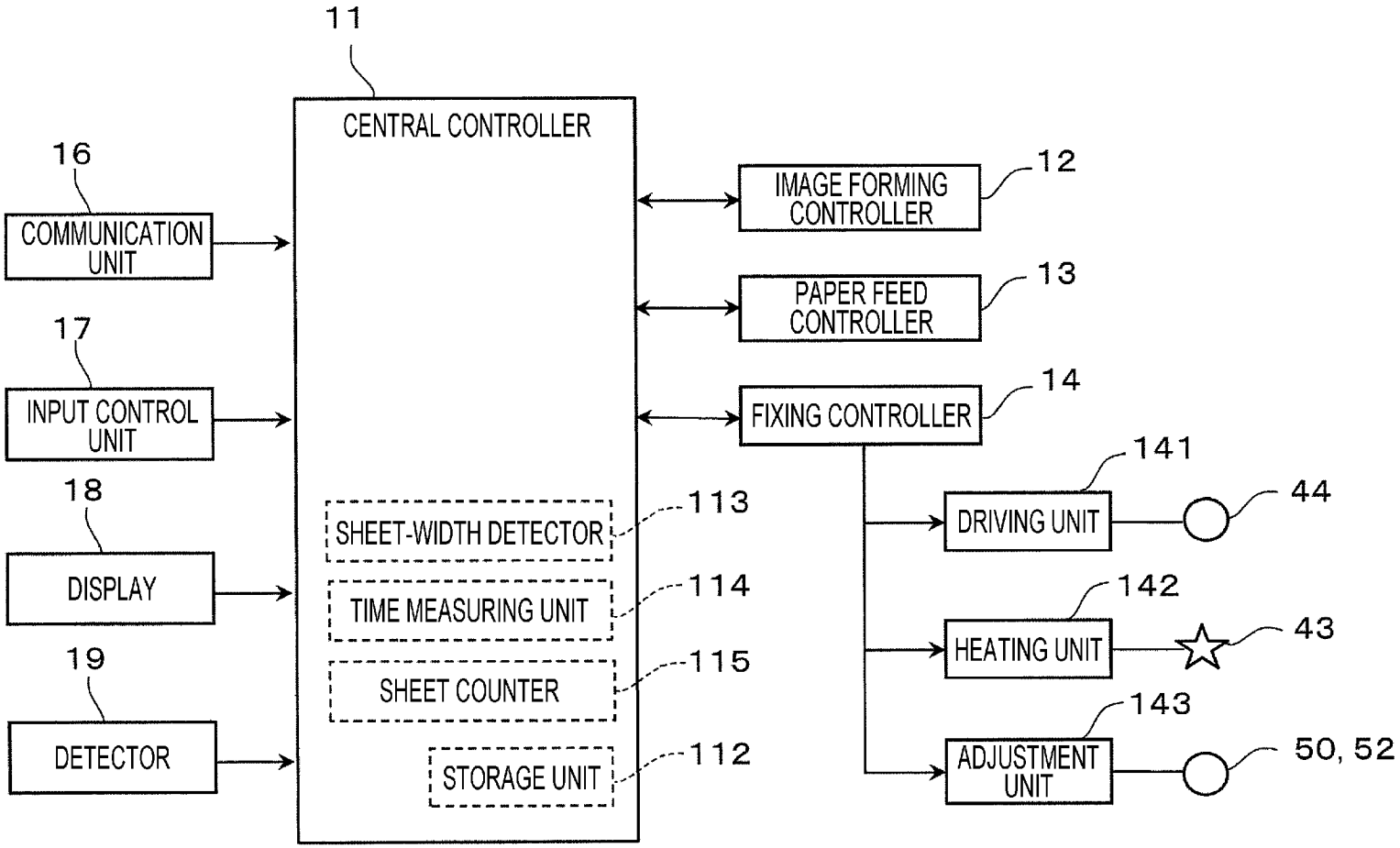
FIG. 3 is a block diagram showing the configuration of a control system of the image forming apparatus.

As shown in FIG. 3, the central controller 11 controls operations of the respective units in the image forming apparatus 1.

The central controller 11 is configured as a section including a central processing unit, a storage unit 112, and an input/output unit and performs predetermined control processing on the basis of control programs, control data, and the like stored in the storage unit 112.

The central controller 11 is connected to an image forming controller 12 that controls the operation of the image forming unit 2, a paper feed controller 13 that controls the operation of the paper feed unit 3, and a fixing controller 14 that controls the operation of the fixing unit 4. The central controller 11 outputs the necessary control signals to the image forming controller 12, the paper feed controller 13, and the fixing controller 14.

The central controller 11 is also connected to a communication unit 16 that communicates with an external device or a network, an input control unit 17 through which necessary information is input when the image forming apparatus 1 is used, a display 18 that displays necessary information related to the operation and manipulation of the image forming apparatus 1, and a detector 19 that detects information necessary for the control. The central controller 11 acquires information from the communication unit 16, the input control unit 17, the display 18, and the detector 19 and outputs the necessary information.

The fixing controller 14 includes: a driving unit 141 that controls the rotational operation of the rotational-driving source 44, which rotates the first rotary member 41, and drives the rotational-driving source 44; a heating unit 142 that controls the heating operation of the heat source 43 in the first rotary member 41 and drives the heat source 43; and an adjustment unit 143 that controls a displacement operation of the rotational-driving source 52, which actuates the displacement mechanisms 50, and drives the rotational-driving source 52. The above-described control related the rotational operation, the heating operation, and the displacement operation is operation control, such as on/off of the power supplied to the rotational-driving sources 44 and 52 and to the heat source 43, and adjustments of the power-supply level.

The central controller 11 includes functional units, such as: a sheet-width detector 113 that detects the width, during transportation, of a sheet 9 subjected to an image forming operation (fixing operation); a time measuring unit 114 that measures the elapsed time; and a sheet counter 115 that counts the number of sheets 9 subjected to an image forming operation.

The sheet-width detector 113 detects the width of a sheet 9 during transportation on the basis of, for example, sheet-size information (including the sheet size in the transport direction) included in an image forming request input through the communication unit 16 or the like and on the basis of information provided by a size detection unit disposed in the paper feed unit 3 to detect the sheet size. The time measuring unit 114 temporarily or cumulatively measures the time required for each operation.

The sheet counter 115 temporarily or cumulatively counts the number of sheets on the basis of information about the number of images to be formed, which is included in an image forming request, and detection information provided by the sheet passing sensor or the like provided near the discharge port 10*b* in the housing 10. In particular, the number of sheets on which images have been properly formed is counted after detection information provided by the sheet passing sensor, which is provided near the discharge port 10*b* in the housing 10, is acquired.

Adjustment in Fixing Unit

In the image forming apparatus 1, it is possible to form images on sheets 9 (9A and 9B) having various widths during transportation. Hence, in the fixing unit 4 (fixing device 4A), when a large-width sheet 9 (9A), which has a larger width than a preceding sheet 9 (9B), which has previously passed through the nip part Np, passes, adjustment in which the first rotary member 41 and the second rotary member 42 are displaced in directions away from each other, while forming the nip part Np, is performed.

Figure 5A:
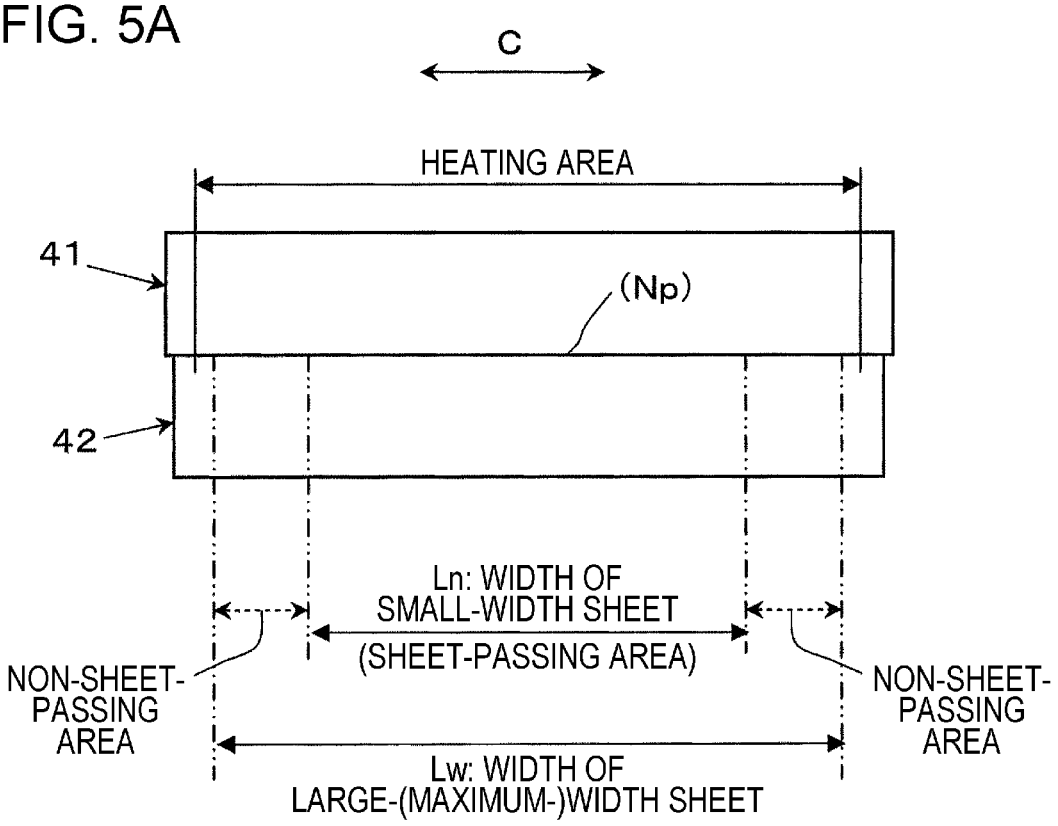
FIG. 5A shows the relationship between a nip part of the fixing unit and the widths of sheets, as well as the states thereof.

In this exemplary embodiment, the large-width sheets 9 are limited to sheets having the maximum width that can be subjected to an image forming operation (including a fixing operation) performed by the image forming apparatus 1, and such sheets will be called large-width sheets (9A). As shown in FIG. 5A, the width of the large-width sheets is the largest width (Lw), which is almost equivalent to the width of a heated area heated by the first rotary member 41 at the nip part Np formed between the first rotary member 41 and the second rotary member 42 in the fixing device 4A. Examples of the maximum width include the length of the short sides of an A3-size sheet (i.e., the width of an A3-size sheet fed such that the longitudinal direction thereof is parallel to the sheet-transport direction) and the length of the long sides of an A4-size sheet (i.e., the width of an A4-size sheet fed such that the longitudinal direction thereof is perpendicular to the sheet-transport direction).

In this exemplary embodiment, any sheet having a smaller width than the large-width sheets 9A will be referred to as a small-width sheet (9B). Examples of the small width include the length of the short sides of an A4-size sheet (i.e., the width of an A4-size sheet fed such that the longitudinal direction thereof is parallel to the sheet-transport direction), the length of the short sides of a B5-size sheet (i.e., the width of a B5-size sheet fed such that the longitudinal direction thereof is parallel to the sheet-transport direction), and the lengths of the short and long sides of a postcard.

This adjustment is performed for the following reasons.

Figure 5B:
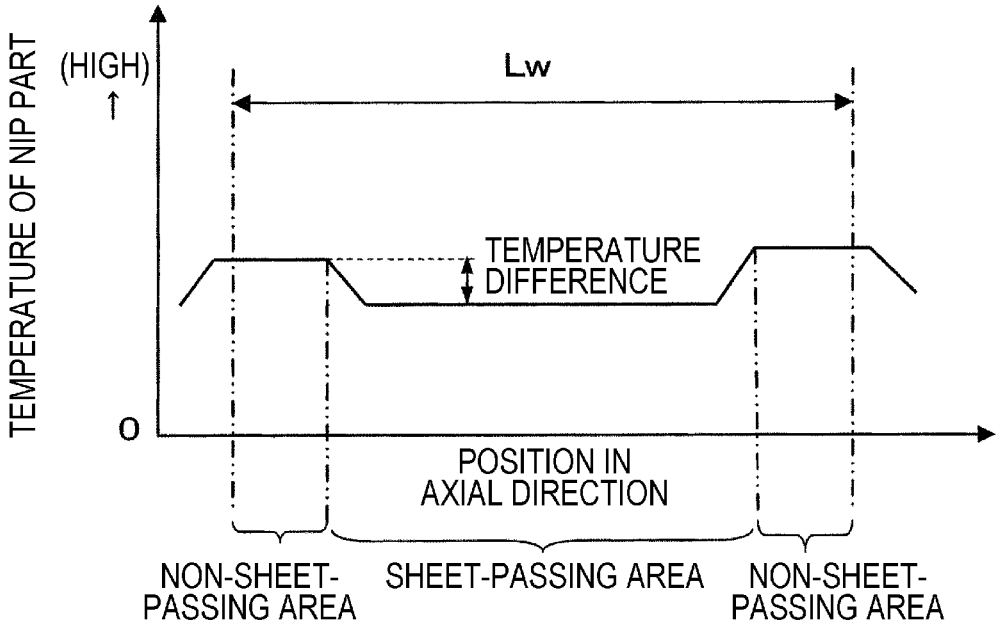
FIG. 5B is a graph showing the temperatures of the nip part after a small-width sheet has passed.

It is known that, when a small-width sheet has passed through the nip part Np in the fixing device 4A for fixing, as shown in FIG. 5A, the nip part Np has a sheet-passing portion (sheet-passing area) in which the preceding small-width sheet has passed and non-sheet-passing portions (non-sheet-passing areas) in which the preceding small-width sheet has not passed, and there is a temperature difference between these areas, as shown in FIG. 5B.

At this time, in the nip part Np, the temperature of the non-sheet-passing areas is higher than the temperature of the sheet-passing area, since the heat in the sheet-passing area is absorbed by the small-width sheet as it passes therethrough.

Furthermore, in the fixing device 4A having a temperature difference, in at least one of the first rotary member 41 and the second rotary member 42, the outside diameter of the portions corresponding to the non-sheet-passing areas becomes larger than the outside diameter of the portion corresponding to the sheet-passing area. Hence, the sheet transporting speed at the portions corresponding to the non-sheet-passing areas is relatively higher than the sheet transporting speed at the portion corresponding to the sheet-passing area.

Figure 6A:
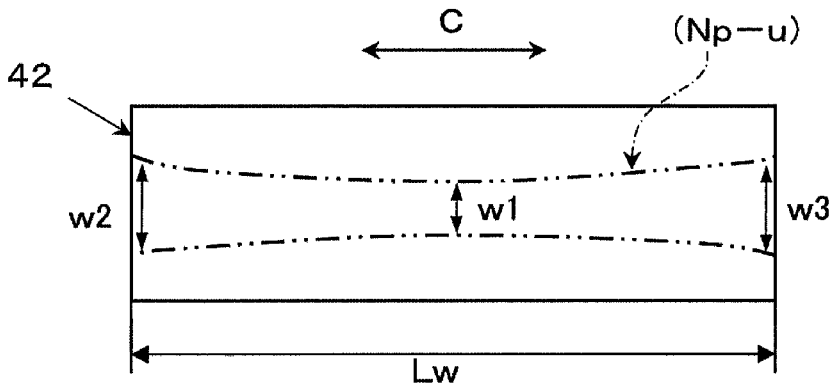
FIG. 6A shows the state of the nip part in a normal state.
Figure 6B:
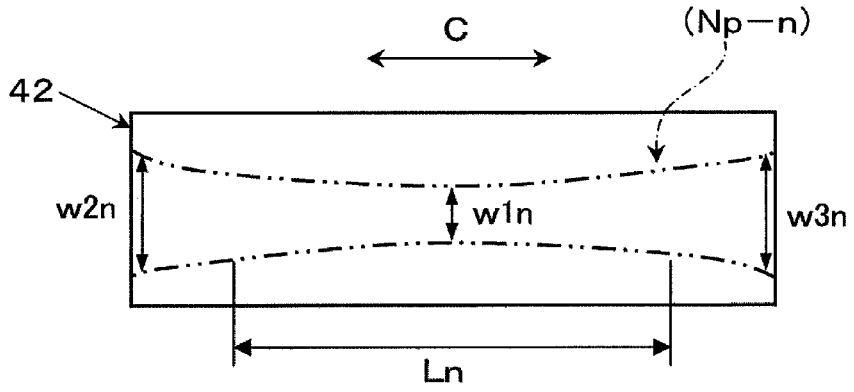
FIG. 6B shows the state of the nip part having a temperature difference caused as a result of a small-width sheet passing.

When the nip part Np has a temperature difference, as shown in FIG. 6B, the nip widths w1*n*, w2*n*, and w3*n* (particularly, w2*n* and w3*n*) of the central portion, the left end, and the right end, respectively, of the second rotary member 42 in the axial direction C, in plan view, are larger than the nip widths w1, w2, and w3 of the central portion, the left end, and the right end, respectively, of the nip part Np in a normal state (see FIG. 6A).

If a large-width sheet is allowed to pass through the nip part Np having a temperature difference for fixing, because the sheet transporting speed varies from part to part in the axial direction of the nip part Np, part of the large-width sheet may be creased, or the unfixed toner image on the creased part may be deteriorated.

One way to avoid such inconvenience is not to perform a fixing operation on a small-width sheet until the temperature difference is eliminated (i.e., until a predetermined period of time has elapsed).

However, this lowers the production efficiency and the working efficiency because the fixing operation on a small-width sheet cannot be performed until the predetermined period of time has elapsed.

The above-described adjustment is performed to enable, even if the nip part Np has a temperature difference, a large-width sheet to pass through the nip part Np for fixing, while suppressing inconvenience due to the temperature difference.

Figure 4:
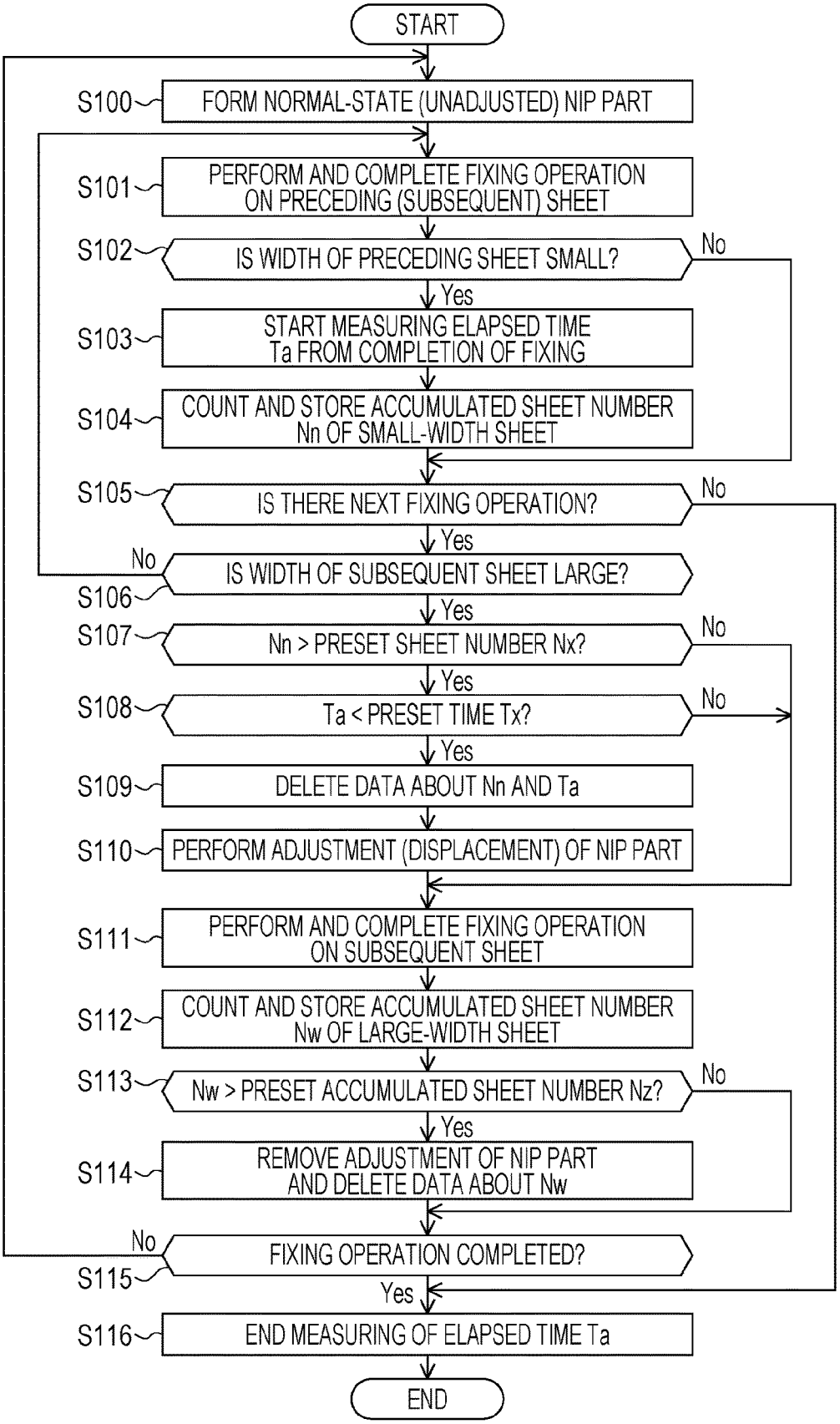
FIG. 4 is a flowchart showing an operation related to adjustment in the fixing unit.

As shown in FIGS. 3 and 4, when the adjustment is needed, the fixing controller 14 controls, via the adjustment unit 143, the operation of the displacement mechanisms 50 in the fixing device 4A.

In the adjustment, the fixing controller 14 causes, via the adjustment unit 143, the eccentric cams 51 of the displacement mechanisms 50 to pivot about the driving shafts 51*a* by a predetermined angle, thus causing the pivot arms 45 to pivot in the direction indicated by arrow E2 by a predetermined amount. As a result, as shown in FIG. 2, the second rotary member 42 is slightly displaced in direction D2 (i.e., the direction away from the first rotary member 41). This adjustment is performed while maintaining a state in which the nip part Np capable of performing a fixing operation is formed.

It is also possible to perform the adjustment each time before a fixing operation on a large-width sheet 9A is performed after a small-width sheet 9B passes through the nip part Np for fixing.

However, the temperature difference in the nip part Np is relatively small at the point when a few small-width sheets 9B have gone through a fixing operation in the fixing device 4A. In this state, even if a fixing operation is performed on a large-width sheet 9A, the inconvenience due to a temperature difference is unlikely to occur.

Hence, in this exemplary embodiment, the adjustment is performed when the number (accumulated sheet number Nn) of the small-width sheets 9B (preceding sheets) that have passed through the nip part Np has exceeded a predetermined number (preset sheet number Nx). Although not specifically limited, the preset sheet number Nx is, for example, 20.

This makes it possible to effectively perform the adjustment at the appropriate time, such as the time when the nip part Np of the fixing device 4A has a temperature difference enough to cause inconvenience.

Alternatively, it is also possible to perform the adjustment every time a fixing operation on a large-width sheet 9A is performed after, for example, the fixing operation on the small-width sheet 9B is performed the preset sheet number Nx of times or more.

In the fixing device 4A, the temperature difference in the nip part Np is naturally eliminated as the time elapsed from completion of the fixing operation on the last small-width sheet 9B to the start of the fixing operation on the next large-width sheet 9A increases.

Hence, in this exemplary embodiment, the adjustment is performed when the elapsed time (Ta) from when the preceding small-width sheet 9B has passed through the nip part Np to when the next large-width sheet 9A starts to pass through the nip part Np has not exceeded a predetermined set time (Tx). Although not specifically limited, the set time T is, for example, 20 seconds.

This makes it possible to avoid unnecessary adjustment, which is performed when the temperature difference in the nip part Np of the fixing device 4A has already been eliminated.

Adjustment Operation in Fixing Unit

The adjustment operation in the fixing unit 4 (fixing device 4A) of the image forming apparatus 1 will be described below.

In the image forming apparatus 1, when the central controller 11 receives a request of an image forming operation from an external device or the like, the image forming unit 2, the paper feed unit 3, and the fixing unit 4 are activated into an operable state via the image forming controller 12, the paper feed controller 13, and the fixing controller 14.

As shown in FIG. 4, first, the nip part Np in the fixing unit 4 (fixing device 4A) is set to a normal state (step S100).

Specifically, the eccentric cams 51 in the displacement mechanisms 50 in the fixing device 4A are caused, via the adjustment unit 143 of the fixing controller 14, to pivot to a predetermined position where the eccentric cams 51 should be located when a normal fixing operation is performed. In the normal state of the nip part Np, the above-described adjustment is not performed.

In this state, as shown in FIG. 6A, the nip part Np in plan view has such a shape that, for example, the nip width w1 of the central portion in the axial direction C of the second rotary member 42 is smallest, and the nip widths w2 and w3 of the left and right ends, respectively, are slightly large, because the roller ends are bent due to the pressing force received at the rotation shafts 42*a* located at the ends of the pressure roller.

In a configuration in which the nip part Np is in a normal state when all the image forming operations (fixing operations) are completed, the operation in step S100 is already completed.

When the fixing device 4A is brought into a state capable of performing a fixing operation, and then a fixing operation on a preceding sheet (i.e., the first sheet to be subjected to an image forming operation) is completed (S101), the central controller 11 or the like determines whether this preceding sheet is a small-width sheet, on the basis of the information provided by the sheet-width detector 113 (S102).

When it is determined that the preceding sheet is a small-width sheet, the time measuring unit 114 in the central controller 11 starts to measure the elapsed time Ta from the completion of fixing (S103), and the sheet counter 115 in the central controller 11 counts and stores the accumulated sheet number Nn of the small-width sheets (9B) (S104). Thereafter, the central controller 11 or the like determines whether there is a next fixing operation (S105).

When it is determined that the preceding sheet is not a small-width sheet in step S102, the process proceeds to step S105.

When it is determined that there is a next fixing operation in step S105, it is determined whether the next sheet is a large-width sheet (S106).

When it is determined that the next sheet is not a large-width sheet, it is determined that the next sheet is a small-width sheet, and the process returns to step S101, where the fixing operation on the next sheet is performed, and subsequent steps S102 to S105 are performed similarly to the above.

When it is determined that the next sheet is a large-width sheet (9A) in step S106, it is determined whether the accumulated sheet number Nn of the small-width sheets (9B) has exceeded the preset sheet number Nx (S107), and it is determined whether the elapsed time Ta from the completion of the previous fixing operation has exceeded a preset time Tx (S108).

When it is determined that the accumulated sheet number Nn has exceeded the preset sheet number Nx in step S107, and when it is determined that the elapsed time Ta has exceeded the preset time Tx in step S108, it is considered that the temperature difference in the nip part Np is large and still exists. In that case, after the used data about the accumulated sheet number Nn and the elapsed time Ta is deleted (S109), the adjustment of the nip part Np is performed (S110).

In the adjustment, as described above, the fixing controller 14 actuates the displacement mechanisms 50, via the adjustment unit 143, to displace the second rotary member 42 in direction D2 (i.e., the direction away from the first rotary member 41) by a predetermined amount.

Figure 6C:
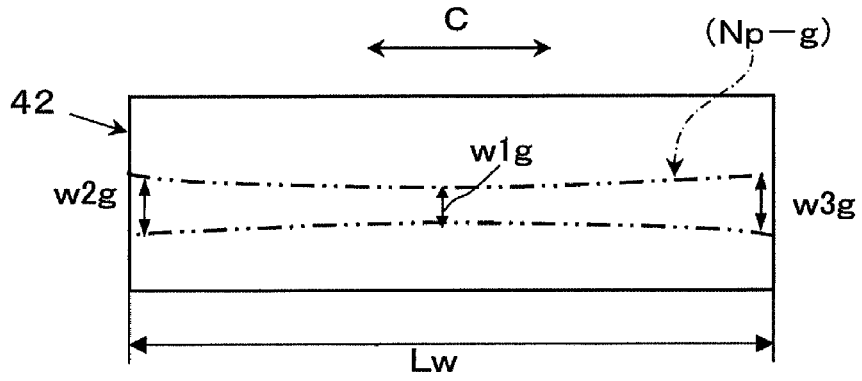
FIG. 6C shows the state of the nip part after adjustment is performed.

As a result, as shown in FIG. 6C, in the nip part Np after the adjustment, the nip widths w1*g*, w2*g*, and w3*g* (particularly, w2*g*, and w3*g*) of the central portion, the left end, and the right end, respectively, of the second rotary member 42 in the axial direction C, in plan view, are smaller than the nip widths w1*n*, w2*n*, and w3*n* of the central portion, the left end, and the right end, respectively, of the nip part Np that still has a temperature difference, as shown in FIG. 6B.

Although the temperature difference still exists in the nip part Np after the adjustment, the nip widths w1*g*, w2*g*, and w3*g* of the nip part Np, in plan view, are slightly smaller than the nip widths w1, w2, and w3 of the nip part Np in a normal state, as shown in FIG. 6A.

The fixing operation on the large-width sheet (9A) is performed by the fixing device 4A immediately after the adjustment (S111).

In the fixing operation at this time, the large-width sheet 9A is allowed to pass through the nip part Np that still has a temperature difference. However, the nip widths w1*g*, w2*g*, and w3*g* of the nip part Np after the adjustment (see FIG. 6C) are smaller than the nip widths w1*n*, w2*n*, and w3*n* of the nip part Np (see FIG. 6B) that is not adjusted and thus still has a temperature difference and the nip widths w1, w2, and w3 of the nip part Np in a normal state (see FIG. 6A).

Hence, in the fixing device 4A, the above-described inconvenience (i.e., a difference in the sheet transportation speed) due to increased outside diameters of the portions of the first rotary member 41 and the second rotary member 42 corresponding to the non-sheet-passing areas is less likely to occur, and a large-width sheet 9A is transported at substantially the same speed in the axial direction C during fixing. Furthermore, the nip part Np after the adjustment is also the nip part necessary for the fixing operation, the fixing operation performed at this time is substantially the same as the normal fixing operation. That is, in the fixing device 4A at this time, the fixing operation is performed on the large-width sheet 9A while the inconvenience due to a temperature difference in the nip part Np is suppressed.

Hence, in this image forming apparatus 1, when a large-width sheet 9A, which has a larger width than a small-width sheet 9B, which has previously passed through the nip part Np of the fixing unit 4, is allowed to pass through the nip part Np, even if there is a temperature difference in the nip part Np between the sheet-passing portion, in which the preceding small-width sheet 9B has passed, and the non-sheet-passing portions, in which the preceding small-width sheet 9B has not passed, the large-width sheet 9A is allowed to pass through the nip part Np for fixing, while the inconvenience due to the temperature difference is suppressed. Hence, it is possible to perform the fixing on the large-width sheet 9A almost without needing to wait until the temperature difference in the nip part Np is eliminated.

When it is determined that the accumulated sheet number Nn has not exceeded the preset sheet number Nx in step S107, and when it is determined that the elapsed time Ta has not exceeded the preset time Tx in step S108, it is considered that the temperature difference in the nip part Np is small or has already been eliminated. In that case, the adjustment in step S110 is not performed, and the fixing operation on the large-width sheet 9A, which is the next sheet, is performed and completed (S111).

After the fixing operation on the large-width sheet 9A in step S111 is completed, the sheet counter 115 of the central controller 11 counts and stores the accumulated sheet number Nw of the large-width sheets (9A) (S112). Thereafter, it is determined whether the accumulated sheet number Nw has exceeded a preset accumulated sheet number Nz (S113).

When it is determined that the accumulated sheet number Nw has exceeded the preset accumulated sheet number Nz, it is considered that the temperature difference in the nip part Np after the adjustment is also eliminated. Hence, the adjustment in the nip part Np is removed, and the used data about the accumulated sheet number Nw is deleted (S114).

When the adjustment is removed, the fixing controller 14 actuates the displacement mechanisms 50, via the adjustment unit 143, to displace the second rotary member 42 in direction D1 (i.e., the direction toward the first rotary member 41) by a predetermined amount (i.e., the amount equal to the amount displaced when the adjustment is performed).

As a result, in the fixing device 4A, the temperature difference in the nip part Np is eliminated, and moreover, the fixing operation is performed with the nip part Np in a normal state, which is the state before the adjustment (FIG. 6A). Although the accumulated sheet number Nw of the large-width sheets 9A with which the adjustment is removed is not specifically limited, herein, the accumulated sheet number Nw is set to, for example, ten.

When it is determined that the accumulated sheet number Nw of the large-width sheet 9A has not exceeded the preset accumulated sheet number Nz in step S113, it is considered that the temperature difference still exists in the nip part Np after the adjustment. In that case, it is determined whether all the fixing operations in the requested image forming operation have been completed (S115), without removing the adjustment or deleting the data about the accumulated sheet number Nw in step S113.

Also after step S114, the process proceeds to step S115.

When it is determined that all the fixing operations have not yet been completed in step S115, it is considered that there are remaining fixing operations, and the process returns to step S100 and repeats the above-described steps.

When it is determined that all the fixing operations have been completed in step S115, it is considered that there are no remaining fixing operations, and the measurement of the elapsed time Ta from the completion of the first fixing operation on the small-width sheets 9B is ended (S116). Also in the case where it is determined that there is no subsequent fixing operation in step S105, the process proceeds to step S116.

Through these steps, the adjustment (control) in the fixing unit 4 in the requested image forming operation is completed.

Modification

In this exemplary embodiment, when the adjustment in the fixing unit 4 becomes necessary, the second rotary member 42 is displaced in direction D2 (i.e., the direction away from the first rotary member 41) by a predetermined displacement amount.

However, in the adjustment in the fixing unit 4, multiple displacement amounts may be set in advance, and the second rotary member 42 may be displaced by one of the displacement amounts according to the accumulated sheet number Nn of the small-width sheets 9B that have passed through the fixing unit 4 before the fixing operation on the large-width sheet 9A is performed.

Figure 7:
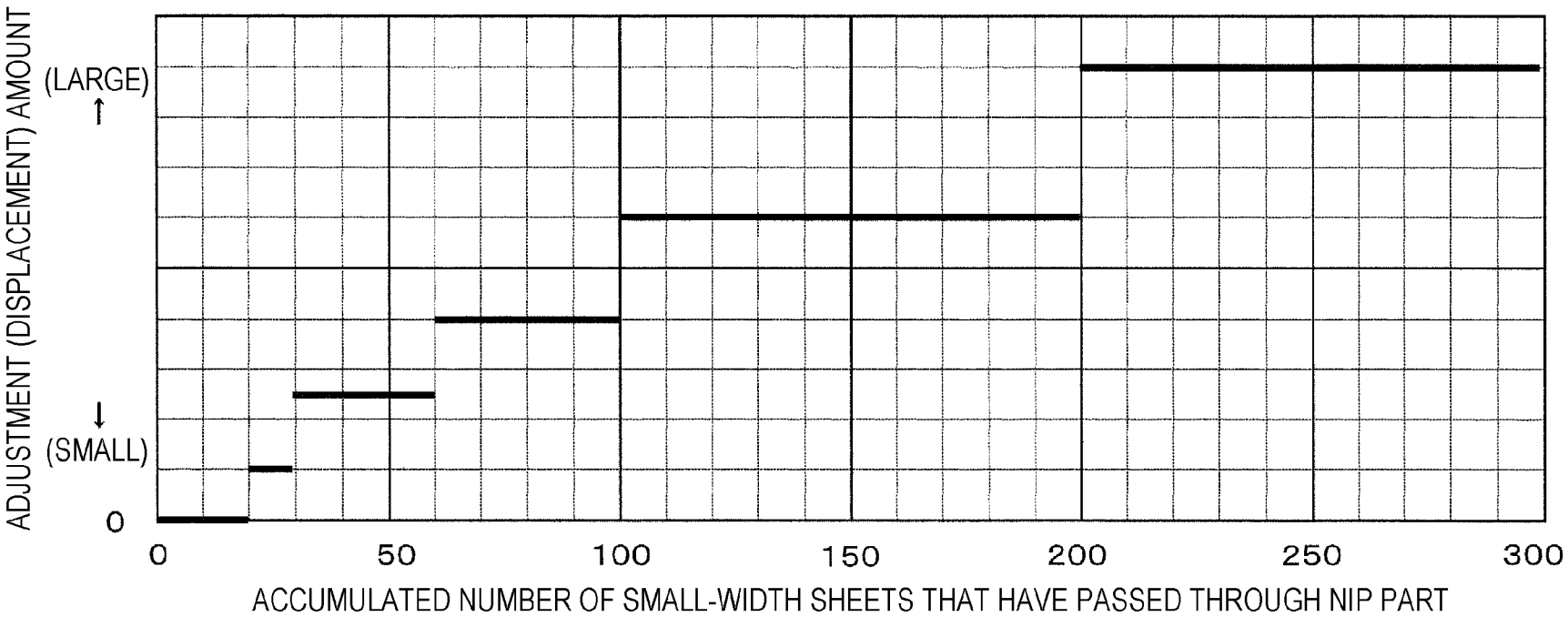
FIG. 7 shows a modification related to setting of the amount of displacement during adjustment.

That is, in the adjustment, for example, as shown in FIG. 7, multiple displacement amounts are set so as to gradually increase with the accumulated sheet number (Nn) of the small-width sheets. In the example shown in FIG. 7, the temperature difference in the nip part Np increases with the accumulated sheet number of the small-width sheets. Hence, to suppress the inconvenience caused by the temperature difference, the displacement amount is gradually increased according to the rate at which the accumulated sheet number of the small-width sheets increases.

When the displacement amounts are set like this, the adjustment is appropriately performed according to the magnitude of the temperature difference in the nip part Np, which varies with the number of the small-width sheets that have passed through the nip part Np. As a result, a fixing operation on the subsequent large-width sheets is performed relatively quickly, in a stable manner.

In the adjustment, the displacement amount may be changed according to the condition, such as the material or the grammage, of the small-width sheets. Alternatively, because the amount of heat or the pressure required in fixing of the subsequent large-width sheets may vary, the displacement amount may be changed according to the condition, such as the material or the grammage, of the large-width sheets.

In the configuration example described in this exemplary embodiment, only the adjustment of the nip part Np is performed before a fixing operation on a large-width sheet is performed after the fixing operation is continuously performed on the small-width sheets.

In this case, control in which the amount of heat applied to the large-width sheet (9A) at the nip part Np is increased may be performed in addition to that adjustment.

Examples of such control include reducing the rotation speed of the first rotary member 41 (in this case, the time taken by a large-width sheet to pass through the nip part Np increases, thus increasing the heating time) and increasing the heating temperature of the first rotary member 41.

When the control in which the amount of heat applied to a large-width sheet is increased is performed in addition to the adjustment like this, a fixing failure due to the adjustment in which the first rotary member 41 and the second rotary member 42 are displaced in directions away from each other (in particular, fixing failure due to insufficient heating) is suppressed.

The first rotary member 41 and the second rotary member 42 in the fixing unit 4 does not necessarily have to be the combination of rollers, as described in this exemplary embodiment, but may be the combination of, for example, a roller and a belt, or the combination of belts.

Furthermore, the configuration of the image forming apparatus 1 is not limited to the example shown in this exemplary embodiment, and the image forming apparatus 1 may have any other configuration as long as it has the fixing unit 4.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming unit that forms an unfixed image on a sheet; and a fixing unit that includes a first rotary member and a second rotary member, which are in contact with each other to form a nip part, and that fixes the unfixed image formed in the image forming unit to the sheet by allowing the sheet to pass through the nip part, wherein, when a large-width sheet having a larger width than a preceding sheet that has previously passed through the nip part is allowed to pass through the nip part, adjustment in which the first rotary member and the second rotary member are displaced in directions away from each other, while forming the nip part, is performed in the fixing unit.

2. The image forming apparatus according to claim 1, wherein the adjustment is performed when the number of the preceding sheets that have passed through the nip part has exceeded a predetermined number.

3. The image forming apparatus according to claim 2, wherein the adjustment is removed when the number of the large-width sheets that have passed through the nip part has exceeded a predetermined number.

4. The image forming apparatus according to claim 3, wherein, in the adjustment, control in which the amount of heat applied to the large-width sheet at the nip part is increased is also performed.

5. The image forming apparatus according to claim 2, wherein, in the adjustment, the first rotary member and the second rotary member are displaced by an amount determined in advance according to the number of the preceding sheets that have passed through the nip part.

6. The image forming apparatus according to claim 2, wherein, in the adjustment, control in which the amount of heat applied to the large-width sheet at the nip part is increased is also performed.

7. The image forming apparatus according to claim 1, wherein the adjustment is performed when the time elapsed from when the preceding sheet has passed through the nip part to when the large-width sheet starts to pass through the nip part has not exceeded a predetermined time.

8. The image forming apparatus according to claim 7, wherein the adjustment is removed when the number of the large-width sheets that have passed through the nip part has exceeded a predetermined number.

9. The image forming apparatus according to claim 7, wherein, in the adjustment, the first rotary member and the second rotary member are displaced by an amount determined in advance according to the number of the preceding sheets that have passed through the nip part.

10. The image forming apparatus according to claim 7, wherein, in the adjustment, control in which the amount of heat applied to the large-width sheet at the nip part is increased is also performed.

11. The image forming apparatus according to claim 1, wherein the adjustment is removed when the number of the large-width sheets that have passed through the nip part has exceeded a predetermined number.

12. The image forming apparatus according to claim 11, wherein, in the adjustment, the first rotary member and the second rotary member are displaced by an amount determined in advance according to the number of the preceding sheets that have passed through the nip part.

13. The image forming apparatus according to claim 11, wherein, in the adjustment, control in which the amount of heat applied to the large-width sheet at the nip part is increased is also performed.

14. The image forming apparatus according to claim 1, wherein, in the adjustment, the first rotary member and the second rotary member are displaced by an amount determined in advance according to the number of the preceding sheets that have passed through the nip part.

15. The image forming apparatus according to claim 1, wherein, in the adjustment, control in which the amount of heat applied to the large-width sheet at the nip part is increased is also performed.

* * * * *